United States Patent [19]

Parren

[11] 4,043,777

[45] Aug. 23, 1977

[54] AIR HANDLING SYSTEM

[76] Inventor: Joseph R. Parren, 11212 N. 37th Drive, Phoenix, Ariz. 85029

[21] Appl. No.: 701,281

[22] Filed: June 30, 1976

[51] Int. Cl.[2] ..... F25D 23/12; F28C 1/00

[52] U.S. Cl. ..... 62/259; 62/315; 62/DIG. 16; 165/47; 261/DIG. 4

[58] Field of Search ..... 62/259, 314, 315, DIG. 16; 165/47; 261/DIG. 4; 98/2.14

[56] References Cited

U.S. PATENT DOCUMENTS

| | | | |
|---|---|---|---|
| 2,344,706 | 3/1944 | Kucher | 62/DIG. 16 |
| 2,799,143 | 7/1957 | Weigel | 62/259 |
| 2,847,834 | 8/1958 | Atchison | 62/DIG. 16 |
| 2,896,428 | 7/1959 | Paton | 62/DIG. 16 |
| 3,263,438 | 8/1966 | Mandlin | 62/259 |
| 3,267,995 | 8/1966 | Mandlin | 62/259 |
| 3,867,486 | 2/1975 | Nagele | 62/DIG. 16 |

*Primary Examiner*—Lloyd L. King
*Attorney, Agent, or Firm*—Gregory J. Nelson

[57] ABSTRACT

An air handling unit is disclosed which comprises a compact unitary assembly of a cooling unit and an exhaust unit. The cooling unit, either an evaporative cooler or a refrigeration unit, delivers cooled air via a delivery duct to a room space. An exhaust system includes a duct and blower communicating with atmosphere and the attic or dead air space to evacuate or exhaust hot air from this space. In alternate embodiments, a clutch arrangement permits selective actuation of the exhaust and cooling units.

3 Claims, 7 Drawing Figures

AIR HANDLING SYSTEM

The present invention relates to an air handling system and more particularly relates to a combination cooling system and exhaust system. The system may include an evaporative or refrigeration unit for discharging and delivering cooled air to an occupied or room space. A separate exhaust duct communicates with the dead air space above the room or area to be cooled and is provided with an exhaust vent at the air handling unit. In the preferred embodiment, a single electric motor drives the blower for delivering cooled air to the room and the fan exhausting air from the dead air space. The blower and fan units may, in one embodiment be selectively actuated by, as for example, electric clutch means.

Air cooling units of the evaporative type and of the conventional refrigeration cycle type are well known. These units are used to cool air for delivery to a room or occupied space for maintaining desired temperatures. It is also known that dead air or crawl spaces such as attics above residence dwellings, impose a substantial heat load on the subjacent rooms. For example, on a hot summer day the temperature in the dead air space may well exceed 160° F. Often the insulation between the dead air space and the subjacent rooms overlaying the room ceiling is insufficient therefore requiring the cooling unit to overcome this additional, substantial heat load. To partially alleviate this condition, it is known in the prior art to provide a vent communicating the dead air space with the outside atmosphere. The vent may be simply in the form of louvered openings.

Other systems to exhaust or evacuate air from the dead air space above a building are known. For example, wind driven turbines are frequently used to induce a positive flow of air from the dead air space to the exterior of the house. The difficulty with these units is that they operate satisfactorily only when adequate breeze or wind is blowing. Therefore, on stultifying, hot days these units are generally not effective.

In a further development of this type of system, exhaust fans for air spaces are supplied which are thermostatically controlled. When the temperature within the dead air space exceeds a predetermined set point, the exhaust fan is automaticaly actuated exhausting a flow of hot air from the dead air space to the atmosphere.

The present invention provides a novel and unique combination cooling and evacuation air handling unit. In accordance with the present invention, a frame adapted for mounting on the roof of a building or at any other suitable location is provided. A suitable cooling unit such as a conventional evaporative cooling unit or refrigeration unit is mounted on the frame. A blower delivers cooled air to a room or occupied space by means of a delivery duct. An exhaust duct communicates with the dead air space above the room. A suitable fan or blower is associated with the exhaust duct. An electric motor is in driving connection with the delivery and exhaust blower or fan. In one embodiment, the fan and blower are selectively clutched so that they may be independently operated. Thus in a single unit cooling and exhaust capabilities are provided increasing the efficiency and economy of the unit and permitting the user to selectively operate the unit in accordance with heat load and demand.

A more complete understanding of the present invention will become apparent from the following description and drawings in which.

Figure 1:
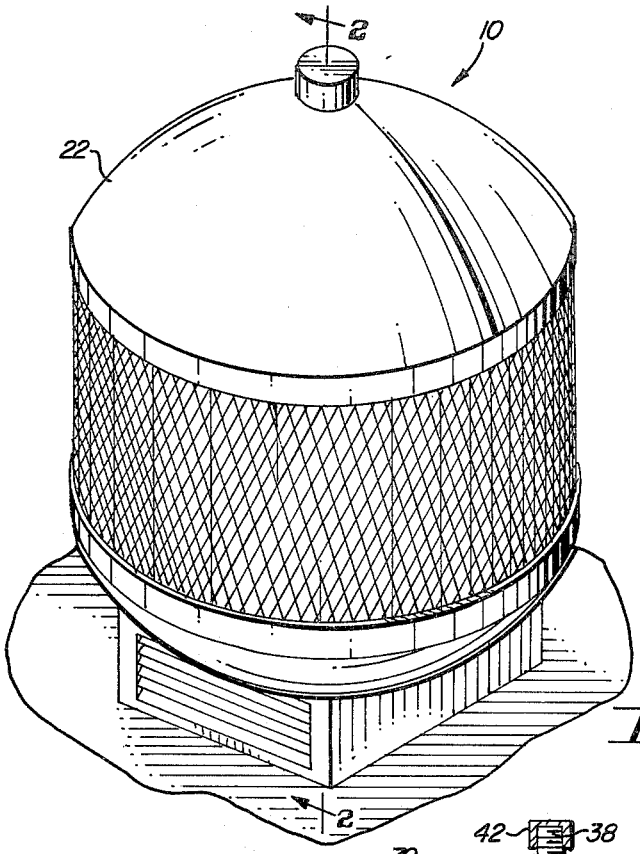
FIG. 1 is a perspective view of the unit of the present invention shown mounted on a building roof.
Figure 3:
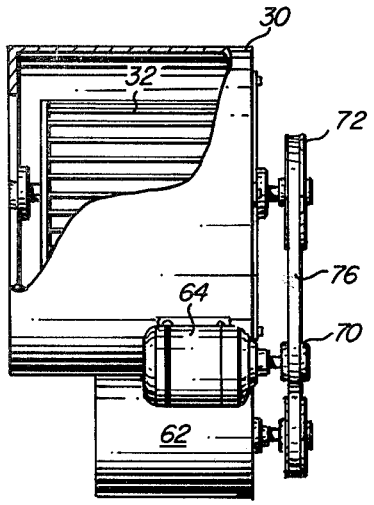
FIG. 3 is a top view of the blower and fan assembly of the unit.
Figure 2:
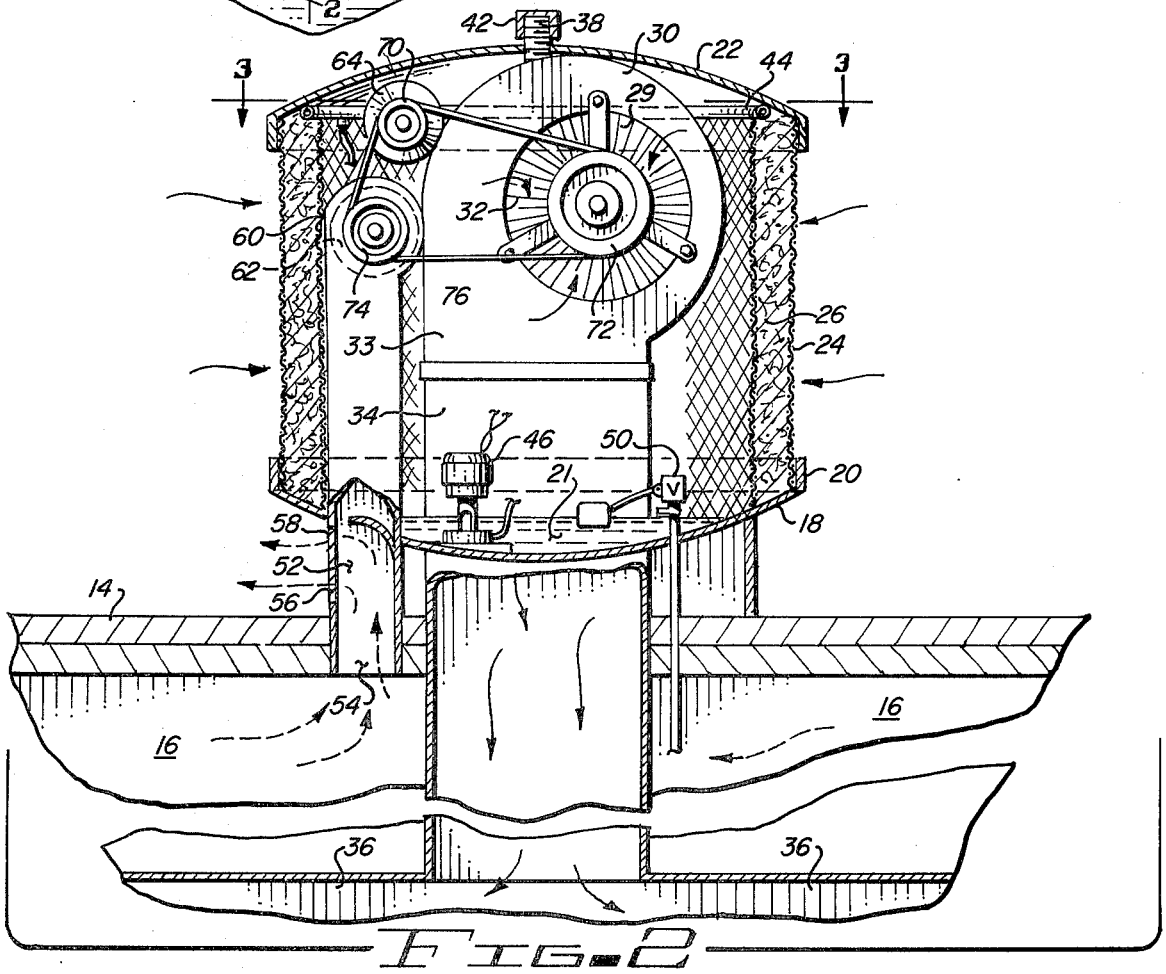
FIG. 2 is a cross-sectional view of the unit of the present invention shown in a mounted position on the roof of a building.

Turning now to the drawings, particularly FIGS. 1 through 3 the air handling unit of the present invention is generally designated by the numeral 10 and includes a generally rectangular base or frame member 12 which as shown is mounted upon the roof of a dwelling 14. As is conventional, an attic or dead air space 16 is provided subjacent the roof and above the occupied or room space of the building, not shown. Frame 12 is attached to the roof by conventional means and peripherally sealed by flashing and application of mastic as is conventional.

In FIGS. 1 throudh 3, the cooling portion of the air handling unit comprises an evaporative cooler having a generally dished base 18 secured to frame 12. An annular generally vertical flange 20 is peripherally attached to base 18 and defines a sump 12 for the evaporative cooler. A generally circular convex head 22 is vertically spaced from the base pan. Preferably both the base 18 and the head 22 are formed from a suitable rust proof material such as Fiberglas. An annular screen assemly 24 extends between the base 18 and the head 22 and supports conventional cooler pad 26.

A centrifugal blower 29 includes a scroll-type housing 30 enclosing a wheel 32 which discharges air generally perpendicular to the shaft on which the wheel is mounted. Blower 29 discharges at outlet section 33 into a vertical delivery duct 34. Delivery duct 34 discharge cooled air into branch ducts 36 which lead to various areas within the building. As is conventional, the ducts and blower housing are formed from sheet metal.

A threaded projection 38 extends vertically from the upper side of housing 30 through a central opening in head 22. Threaded member 38 projects beyond dished head 22 and is held in place by retainer cap 42.

The evaporative cooler portion of the air handling unit works in a conventional manner. An annular water distribution tube 44 extends annularly around the interior of head 22 and discharges water into the top of pad 26. Water distribution tube 44 is supplied by pump 46 from sump 21 within the base 18. A float controlled valve 50 maintains a predetermined water level within sump 21.

The exhaust portion of the air handling unit 10 is also housed within the confines of the evaporative cooler unit. The exhaust system includes a vertical exhaust duct 52 which communicates at inlet 54 with the dead air space 16 subjacent the unit. Duct 54 communicates with atmosphere by means of vent 58 in base 12. Vent 58 may include movable lourvers 56. The upper end of exhaust duct 52 has a generally circular portion 60 which houses an induction fan unit 62. As will become more apparent hereafter, hot air in the dead air space 16 is exhausted under the influence of fan 62 to the atmosphere across vent 58. It will be obvious that fan unit 62 could be an axial flow unit installed adjacent vent 58 for exhausting air from the dead air building space.

The air handling unit shown in FIGS. 1 through 3 is powered by a single electric motor 64. Electric motor 64 is provided with a single groove sheave 70 on its output shaft. Similarly the drive shafts of the blower and fan are respectively provided with sheaves 72 and 74. A V-belt 76 is interconnected between the sheaves and is in driving relationship with the fan and blower.

The operation of the unit is as follows. The unit is installed on base or curb 12 on the roof or adjacent a building to be cooled. For example, it would be possible to side-mount the entire unit on a building although roof mounting is generally more practical. The unit is installed with delivery duct 34 communicating with the cooling duct system 36 within the building. Exhaust duct 54 is installed communicating with the dead air or attic space in the building. Valve 50 is suitably connected to a source of water and pump 46 and electric motor 64 connected to a power source. The electric and hydraulic connections are conventional and detailed explanation of this part of the system is not believed necessary.

When the unit is operational, cooling is affected by evaporation of the water across pad 26. The air drawn across the pads and cooled is directed under the influence of blower 29 into duct 34 and into the interior of the building. At the same time, induction fan 62 is operating and induces a positive flow of hot air from dead air space 16 into duct 54 and to atmosphere across vent 58. Thus, within a single air handling unit, cooling is affected and the effective heat load on the house is reduced as the hot air in the dead air space above the room space is evacuated. Typically, release or evacuation of attic hot air will reduce the temperature in the attic 10° to 15° F. This results in compactness and efficiency of operation. The combined effects of cooling and air evacuation in a single unit results in economy of operation to the user.

Figure 4:
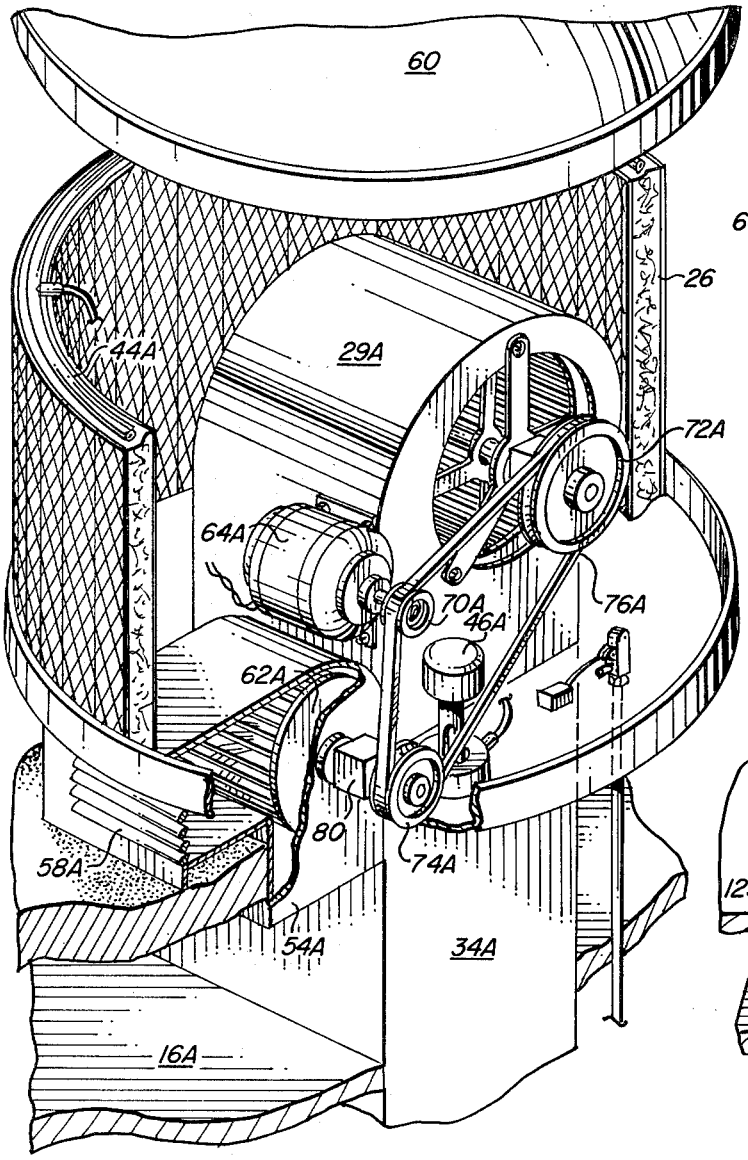
FIG. 4 is a perspective view, partially broken away, illustrating another embodiment of the present invention.
Figure 5:
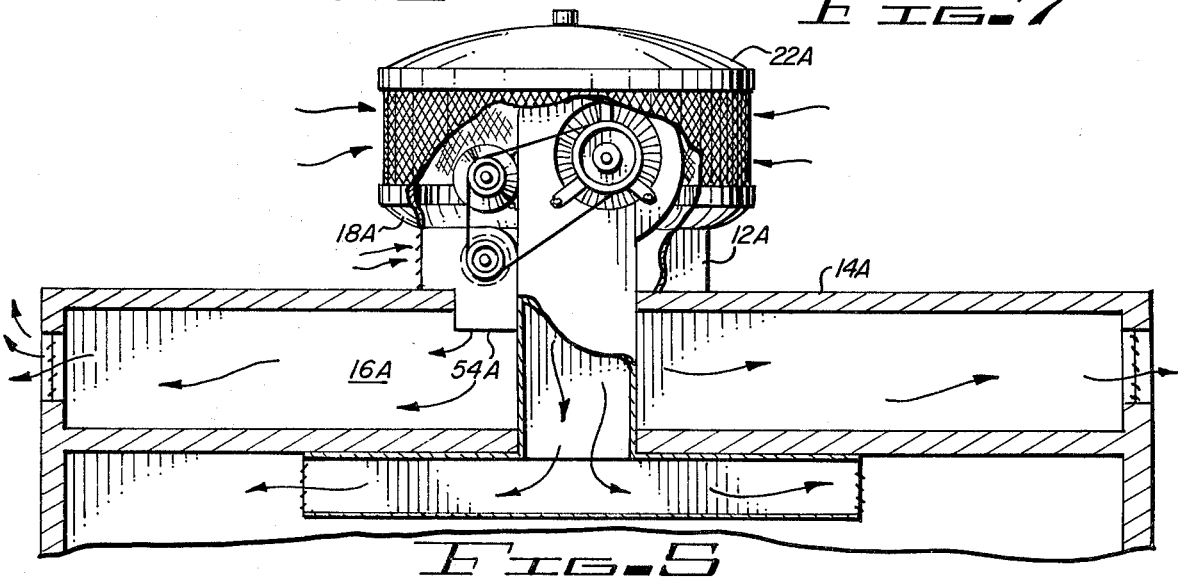
FIG. 5 is a side elevational view, partly in section, illustrating the embodiment shown in FIG. 4.

FIGS. 4 and 5 show another embodiment of the present invention designated by the numeral 60. In this and succeeding embodiments, the same reference numerals have been used to identify the same or similar components with the letter being appended to distinguish from previous embodiments. Unit 10A is mounted on a rectangular base or curb 12A on roof 14A. Evaporative cooler section is as has been described with a convex top 22A and a convex base 18A. Water distribution system 44A delivers water to pad 26A from pump 46A. Cool air is delivered to the interior of the building or the occupied space by means of delivery duct 34A. A centrifugal blower 29A is housed in the upper part of duct 32 for delivery of cool air through duct 34A. Electric motor 64A is mounted on one side of rectangular duct 34A and has an output shaft carrying a sheave 70A. The discharge side of the fan 62A communicates via duct 54A with dead air space 16A in the house. The intake side of fan 60A communicates with the atmosphere across vent 58A. The drive shaft of blower 29A is provided with sheave 72A and the drive shaft of fan 62A carries sheave 74A. A V-belt 76A is in driving connection with sheaves 72A and 74A. Vents 77 communicate dead air space 16A with atmosphere.

Clutches 80 and 82 are interposed between sheaves 74A and 72A and their respective blower units. Clutches 80 and 82 may be selectively actuated to place pulley 72A and 74A, respectively, into driving engagement with the shafts of their respective blowers. Clutches 80 and 82 may be of any conventional type such as a magnetically or electrically actuated clutch having coupling members which can be axially moved into or out of engagement. Clutches of this type are well known in the industry. In other respects the embodiment of the invention shown in FIGS. 4 and 5 operates essentially the same as the embodiment shown in FIGS. 1 through 3 with the exception that the cooler fan and exhaust vent can be selectively, independently operated. For example, with electric motor 64A energized, one or both of the clutches 80 and 82 can be engaged so that, for example, if desired only to exhaust air from the attic space 16A only clutch 80 is actuated. With the exhaust fan actuated, a positive air flow is induced through the attic space 16A causing air to be exhausted at vents 16. Electric motor 64A is accordingly sized so that it can drive both the blower 29A and fan 62A. Further the motor may be selected to provide multiple speed operations. Typically a two or three speed electric motor of the split capacitor type, thermally protected could be selected for this type of application.

Figure 6:
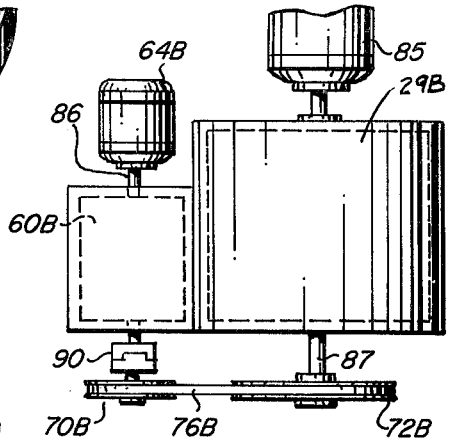
FIG. 6 is a top view showing another arrangement of the cooling and exhaust combination air handling unit.

FIG. 6 illustrates another embodiment of the present invention having a blower 29B and exhaust fan 60B again housed with an evaporative unit, not shown. An electric motor 64B is connected to the drive shaft 86 at one side of the centrifugal blower 60B. Extension 88 of the drive shaft 86 extends from the opposite side of the blower and is connected to clutch 90. The opposite side of the clutch 90 is connected to pulley 70B. Sheave 72B is in driving engagement with blower 29B by means of belt 76B. Electric motor 85 drives blower 29B which delivers cooled air through the delivery system. Blower shaft extension 87 is keyed or otherwise connected to sheave 72B.

In operation, with clutch 90 disengaged and motor 64B actuated, only exhaust blower 60B is in operation. Thus the user can exhaust the dead air space without attendant cooling. In the event the user wishes to operate both the cooling and exhaust blower, clutch 90 is engaged and motor 85 actuated operating blower 29B and blower 60B through sheave 72B, belt 76B and sheave 70B. This system is efficient in that motor 64B is generally much smaller than motor 85 requiring less energy if only the exhaust mode is desired. If both blower units are operated, it is more efficient to use only motor 85 as the prime mover allowing motor 64B to "free-wheel" in a non-energized state.

Figure 7:
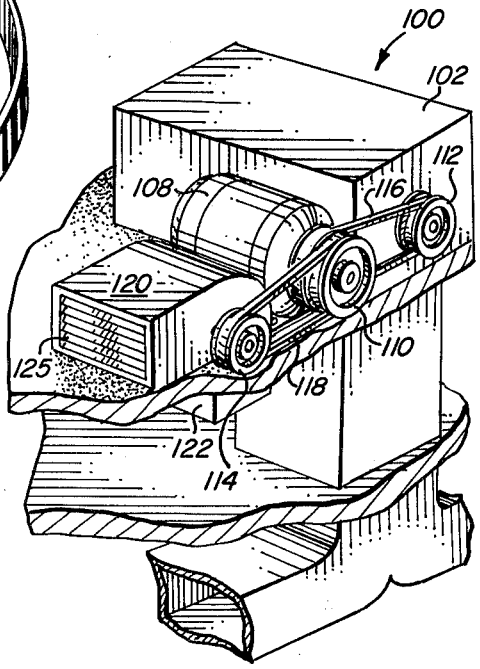
FIG. 7 is a perspective view illustrating another embodiment of the present unit utilizing a refrigeration cycle unit mounted in position on the roof of a building.

FIG. 7 illustrates still another embodiment of the present invention generally designated by the numeral 100. With embodiment 100 cooling is affected by unit 102 which operates on a conventional refrigeration cycle when air is cooled as it passes across the condenser coils of the unit. The details of the refrigeration cycle are well known and it is not necessary to set this description forth in detail in this application. Air conditioning unit 102 houses a blower or fan which delivers cooled air via duct 106 to the building space. The fan of the air conditioning unit is powered by electric motor 108. The system compressor within the unit 102 may also be powered by electric motor 108 or may have its own independent motor. The output shaft of electric motor 108 is provided with a dual groove sheave 110. One groove of pulley 110 is interconnected by belt 116 to sheave 112 of the refrigeration unit 102.

Exhaust duct 122 communicates with the dead air space of the building and discharges at vent 125 to atmosphere. The other groove of sheave 110 is operatively connected by belt 118 to sheave 114 of induction fan 120. It will be obvious that when motor 108 is actuated both the cooling unit 102 and the exhaust unit 120 are powered causing cooling air to be delivered to the building and hot air to be exhausted from the dead air space within the building. The fan 120 and air conditioning unit 102 may be selectively actuated by clutches as mentioned above.

The present invention thus provides a compact unit for cooling which provides the additional capability of evacuation of hot air from attic spaces. This reduces heat loading and increases the economy and efficiency of the cooling unit. The unit may be used by buildings of various construction including those having suspended ceilings. Roof life is also extended due to reduced attic space temperature.

It will be obvious to those skilled in the art to make various changes, alterations and modifications to the embodiments herein chosen for purposes of illustration. To the extent that these changes, alterations and modifications do not depart from the spirit and scope of the appended claims, they are intended to be encompassed therein.

I claim:

1. An air handling unit for cooling a building room and evacuating a dead air space located above the room, said air handling unit comprising:

a. a base member adapted for attachment to the roof of the building;

b. a top member and a bottom member vertically spaced apart, said bottom member defining a sump;

c. an evaporative cooling pad interposed between said top and bottom members and defining an enclosure;

d. means for supplying water from said sump to said pad;

e. first blower means within said enclosure having a discharge connected to a delivery duct communicating with said room;

f. exhaust duct means communicating with the atmosphere and said dead air space;

g. second blower means associated with said exhaust duct means for inducing a flow of air from said dead air space; and h. power transmission means drivingly connected to said first and second blower means.

2. The air handling unit of claim 1 wherein said power transmission means comprises an electric motor in driving engagement with sid first blower means and said second blower means through a belt and pulley arrangement.

3. The air handling unit of claim 1 wherein said power transmission means comprises independent electric motors driving said first blower means and said second blower means.

* * * * *